United States Patent [19]

Thomas et al.

[11] 3,997,111

[45] Dec. 14, 1976

[54] LIQUID JET CUTTING APPARATUS AND METHOD

[75] Inventors: Benjamin A. Thomas, Burton; Edward W. Geller, Mercer Island, both of Wash.

[73] Assignee: Flow Research, Inc., Kent, Wash.

[22] Filed: Sept. 22, 1975

[21] Appl. No.: 615,560

Related U.S. Application Data

[63] Continuation-in-part of Ser. No. 597,508, July 21, 1975, abandoned, which is a continuation of Ser. No. 511,486, Oct. 2, 1974, abandoned.

[52] U.S. Cl. ..... 239/1; 239/596; 239/601; 299/17

[51] Int. Cl.[2] ..... B05B 1/10; E21C 25/60; E21C 37/06

[58] Field of Search ..... 239/1, 4, 11, 101, 102, 239/589, 596, 601, 602; 299/17, 95

[56] References Cited

UNITED STATES PATENTS

| | | | |
|---|---|---|---|
| 3,343,794 | 9/1967 | Voitsekhovsky | 239/101 X |
| 3,419,220 | 12/1968 | Goodwin et al. | 239/596 X |
| 3,521,820 | 7/1970 | Cooley | 239/102 X |
| 3,750,961 | 8/1973 | Franz | 239/596 X |
| 3,756,106 | 9/1973 | Chadwick et al. | 239/601 X |
| 3,823,408 | 7/1974 | Gordon | 239/601 X |

*Primary Examiner*—Robert S. Ward, Jr.
*Attorney, Agent, or Firm*—Robert B. Hughes

[57] ABSTRACT

A high velocity, constant flow, liquid jet cutting apparatus comprising a source of high pressure fluid, a jet nozzle, and a high pressure conduit to carry the fluid from the source to the jet nozzle. Immediately upstream of the jet nozzle is a liquid collimating device comprising a housing interconnected between the conduit and the nozzle and defining a flow collimating chamber directly upstream of the nozzle, through which the high pressure liquid is delivered to the nozzle. The cross sectional area of the flow collimating chamber is at least greater than 100 times the cross sectional area of the nozzle opening, and desirably in the order of four hundred times as great or more. The resulting liquid jet has relatively little dispersion of the liquid and is capable of effectively cutting a relatively narrow kerf with a high quality finish and little, if any, wetting.

14 Claims, 3 Drawing Figures

FIG. 1
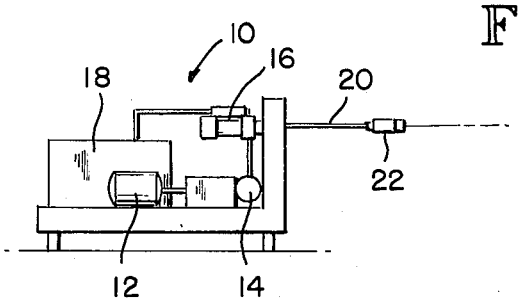
FIG. 2
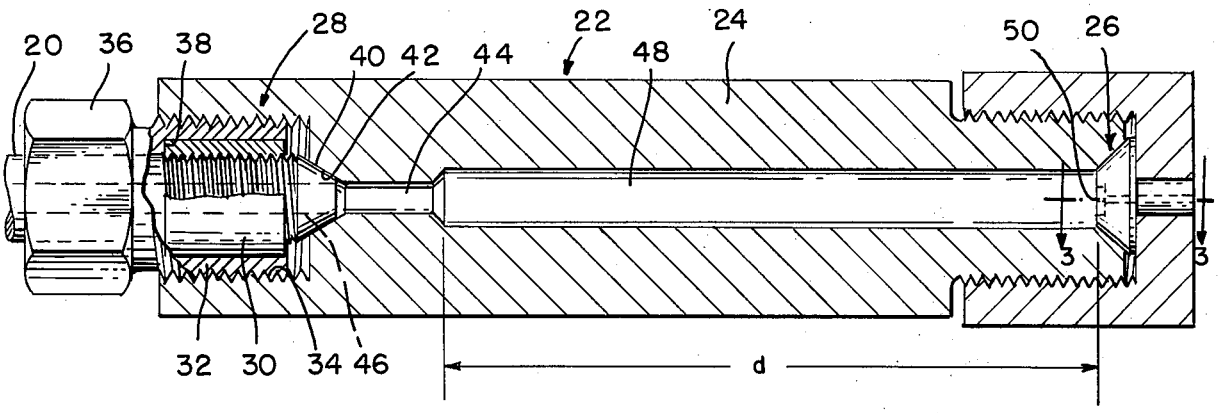
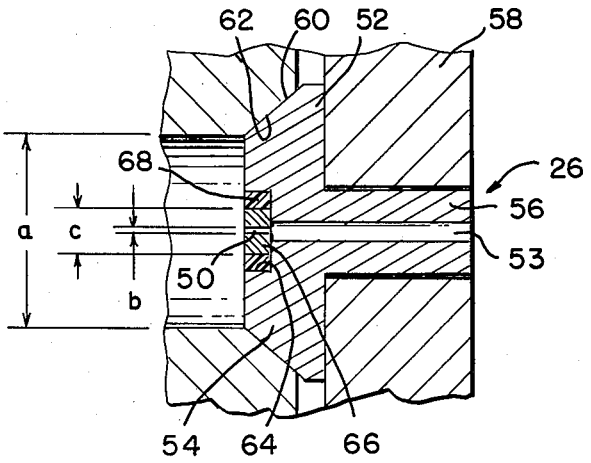
FIG. 3

LIQUID JET CUTTING APPARATUS AND METHOD

CROSS-REFERENCE TO RELATED APPLICATIONS

This is a continuation-in-part application of our U.S. patent application, Ser. No. 597,508, filed July 21, 1975 and now abandoned, which is a continuation application of our U.S. patent application, Ser. No. 511,486, filed Oct. 2, 1974 and now abandoned.

BACKGROUND OF THE INVENTION

1. Field of the Invention

The present invention relates to a method and apparatus for providing a high velocity liquid jet for cutting, and more particularly to means for improving the collimation of the liquid jet for improved cutting action.

2. Brief Description of the Prior Art

The use of liquid jets as a means of cutting, drilling, or abrading various materials has long been known. For example, there is the practice of hydraulic mining, where a high pressure liquid jet is used to cut through rock formations, coal formations or the like. Representative of the prior art in this field are the following patents: Kirschniok, U.S. Pat. No. 878,208; Haag, U.S. Pat. No. 1,530,768; Howell, U.S. Pat. No. 1,856,836; Schroepfer, U.S. Pat. No. 2,018,926; Bigelow, U.S. Pat. No. 2,304,143; Aston et al., U.S. Pat. No. 2,518,591; Lindbergh et al., U.S. Pat. No. 3,104,186; Bobo, U.S. Pat. No. 3,112,800; Andersen, U.S. Pat. No. 3,203,736; Book, U.S. Pat. No. 3,326,607; Pittman, U.S. Pat. No. 3,331,456; Goodwin et al., U.S. Pat. No. 3,375,887; Goodwin et al., U.S. Pat. No. 3,419,220; Johnson, Jr., U.S. Pat. No. 3,528,704; Aarup, U.S. Pat. No. 3,536,151; Chaney, U.S. Pat. No. 3,554,602; Okabe, U.S. Pat. No. 3,572,839; and Taylor et al., U.S. Pat. No. 3,799,615.

Also known in the prior art are various devices for producing very high velocity pulsed liquid jets. One of the reasons for providing the pulsed jet is that relatively higher pressures are obtainable than would otherwise be possible with comparable apparatus for steady state flow. Typical of such devices are those shown in the following patents: Hansell, U.S. Pat. No. 2,512,743; Stanton, U.S. Pat. No. 2,665,052; Voitsekhovsky, U.S. Pat. No. 3,343,794; Cooley, U.S. Pat. No. 3,490,696; McDonald, U.S. Pat. No. 3,514,037; Cooley, U.S. Pat. No. 3,520,477; Cooley, U.S. Pat. No. 3,521,820; Cooley, U.S. Pat. No. 3,539,104; Abrams et al., U.S. Pat. No. 3,653,596; Beck, Jr., U.S. Pat. No. 3,704,966; Cobb et al., U.S. Pat. No. 3,729,137; Hall et al., U.S. Pat. No. 3,746,256; Godfrey, U.S. Pat. No. 3,748,953; and Cooley, U.S. Pat. No. 3,784,103. Representative of the prior art of patents showing another nozzle configuration is Franz, U.S. Pat. No. 3,750,961.

In recent years, there has been development work on high pressure intensifiers capable of producing a substantially constant discharge of a fluid jet stream at velocities in the order of 1,200 feet per second and substantially greater. Such a device is shown in U.S. Pat. No. 3,811,795. One of the practical applications of such a device is in jet cutting, in which a small diameter fluid jet (e.g. having a diameter between several hundreth to as small as several thousandths of an inch) is used to cut a relatively narrow kerf in a variety of materials, such as wood, fabric, sandstone, etc.

Usually this type of liquid jet cutting with a relatively small, very high velocity liquid jet is a reasonably precise operation, so that one of the major considerations is to avoid undue dispersion of the liquid jet, which stated positively is to provide a more "coherent" or "collimated" jet stream. The advantages of such a collimated jet stream are several, for example, cutting more efficiently, cutting a narrower kerf, having a better finish along the cut surfaces, avoiding undue wetting of the material being cut, etc. To the best knowledge of the applicant herein, most of the efforts to avoid dispersion of the jet have been directed toward improving the nozzle configuration and providing carefully contoured converging surfaces leading into the nozzle opening. One such approach is shown in U.S. Pat. No. 3,756,106 wherein is shown a corundum crystal of a particular configuration capable of producing a very high pressure liquid jet for relatively precise cutting operations, such as listed above. Thus, the main components of a prior art liquid jet cutting apparatus comprise a source of high pressure liquid, conduit means to carry the liquid to the area of cutting, and a carefully constructed and/or contoured nozzle assembly to receive the high pressure liquid from the conduit means and discharge this liquid as a small diameter, high velocity cutting jet.

SUMMARY OF THE INVENTION

The present invention comprises an improvement to the aforementioned conventional apparatus for liquid jet cutting, wherein there is a source of high pressure liquid (such as a high pressure intensifier), conduit means to carry this liquid from the source to the location where the cutting is accomplished, and a suitable nozzle to discharge the liquid as a high velocity small diameter jet. This improvement enhances the collimation or coherence of the liquid jet so as to improve the cutting action of the jet with respect to such features as reduced kerf width, improved finish on the cut surfaces, less wetting, potential gains in productivity and cutting speed, etc. The improvement comprises housing means interconnected between the conduit means and the nozzle, with the housing means defining a flow collimating chamber directly upstream of the nozzle to receive the liquid from the conduit means and deliver the liquid directly to the nozzle, the flow chamber having a cross sectional area at least greater than 100 times that of the discharge opening of the nozzle. Preferably the cross sectional area of the collimating chamber should be greater than 200 times that of the nozzle; there is more improvement when the above-mentioned ratio is in the order of 400 times or greater, and yet more improvement when this ratio is in the order of 1,000 or 1,400. Beyond this ratio of 1,400, no substantial improvement in coherency of the stream has been observed.

While the phenomenon of achieving greater coherency of the jet stream by use of such a collimating chamber may not be fully understood, it is believed that the following hypothesis can reasonably be advanced at least as a partial explanation of the phenomenon. However, it is to be understood that regardless of the accuracy or validity of this hypothesis, the present invention has in fact provided a new and useful apparatus and method, with which there is significant improvement in the cutting action by improvement of collimation in the jet stream.

In this hypothesis, it can be presumed that on of the factors affecting the dispersion of a liquid jet stream is the turbulence within the liquid stream. Such turbulence might be considered as very small eddy currents in the liquid which produce greater interaction between the liquid at the surface of the jet stream and the boundary of air adjacent the jet stream, which in turn results in dispersion of the liquid into the surrounding air. It has been recognized that a major potential source of turbulence is the nozzle configuration and the contouring of the converging walls leading to the nozzle. It has also been recognized that the flow characteristics of the liquid upstream of the nozzle can affect the turbulence of the liquid. Accordingly, the cross sectional area or flow area of the conduit means has usually been made several times larger, and often many times larger than the cross sectional area of the nozzle discharge opening. However, it has been presumed in the prior art that when the cross sectional area of the flow passage in the conduit approaches a value as great as 100 times the cross sectional area of the nozzle, no particular advantage can be obtained by further increasing this cross sectional area.

Further, where very high liquid pressures are encountered (e.g. in the order of 50,000 psi or more), there are design considerations which indicate that the diameter of the flow passage in the conduit be kept within reasonable limits. Since the force of a fluid in a high pressure conduit tending to split the conduit into two halves generally along a plane coincident with the longitudinal center axis of the conduit is directly proportional to the diameter of the flow passage for the liquid in the conduit, an increase in the diameter of the flow passage causes a corresponding increase in the wall thickness to enable the conduit to withstand the higher forces. In other words, if the diameter of the flow passage in the conduit doubles, it is necessary to double the thickness of the wall of the conduit or in the alternative make other provisions for doubling the ability of the conduit to resist the burst forces of the contained high pressure liquid.

To return to the hypothesis of the present invention, it is believed that if at a location immediately upstream of the discharge nozzle the fluid is directed through a flow chamber having a cross sectional area substantially larger, relative to the nozzle area, than that taught by the prior art, there is a reduction of turbulence in the liquid passing from this chamber into the nozzle with this reduction in turbulence resulting in substantial improvement in the collimating or coherence characteristics of the liquid jet. However, as indicated above, regardless of the correctness of this hypothesis, it has been demonstrated that this phenomenon does exist. As used herein, this chamber of the present invention provided immediately upstream of the nozzle is termed a "collimating chamber" to relate it to this phenomenon, and will be referred to in that language in the course of the following detailed description.

According to another facet of the present invention, there is provided a particular nozzle configuration to enhance performance of the liquid jet. This nozzle assembly comprises a nozzle housing having a counterbore which receives the nozzle element or nozzle orifice (i.e. the element having the liquid discharge opening). Surrounding the nozzle element is a mounting ring made of a moderately yielding material such as a suitable plastic. This ring fits around the nozzle element and is press fitted into the counterbore of the nozzle housing, with the exposed surfaces of the ring and nozzle element being subjected to the high pressures of the working liquid. The opposite surface of the nozzle element is pressed against the bottom surface of the recess or counterbore of the nozzle housing. The mounting ring serves three functions. First, it provides uniform radially inward pressure around the nozzle element so as to prevent cracking of the nozzle element or other damage thereto. Second, the ring reduces the tolerance requirements between the lateral surface of the counterbore and the lateral surface of the nozzle element. Third, the mounting ring, under very high pressure, provides an adequate seal between the nozzle element and the bottom wall of the counterbore against which the nozzle element rests. The rear face of the nozzle assembly has a rearwardly tapering conical surface which fits against a matching conical surface of the main housing that defines the collimating chamber, so as to provide a seal therebetween.

BRIEF DESCRIPTION OF THE DRAWING

FIG. 1 is a side elevational view of a liquid jet cutting apparatus incorporating the present invention;

FIG. 2 is a longitudinal view, partly in section, of the collimating housing and nozzle of the present invention; and FIG. 3 is an enlarged sectional view of the forward part of the collimating housing and nozzle assembly of the present invention.

DESCRIPTION OF THE PREFERRED EMBODIMENT

With reference to FIG. 1, there is shown the over all jet cutting apparatus 10, comprising an electric motor 12, which drives a hydraulic pump 14, which in turn supplies working fluid to a high pressure intensifier unit 16. The intensifier 16 draws fluid (i.e. water) from a suitable source, such as a reservoir 18, and discharges the water at a very high pressure through a conduit 20. At the discharge end of the conduit 20 is a discharge assembly 22, which provides a very high velocity, small diameter liquid cutting jet.

This discharge assembly 22 is shown more particularly in FIG. 2; it comprises a main generally cylindrical elongate housing 24 having a front discharge end connecting to a nozzle assembly 26 and a rear end by which it is connected to the discharge end of the conduit 20 by means of connector 28. The connector 28 is of conventional design, and hence will be described only briefly herein. It comprises an inner collar 30 which is threaded onto the discharge end of the conduit 20. Surrounding the sleeve 30 is a second sleeve element 32 which has exterior threads that engage mating threads in a recess or socket 34 formed in the rear of the housing 24. Rigidly connected to the rear end of the sleeve 32 is a head portion 36 having an inwardly extending lip portion 38 which engages the rear end of the inner sleeve 30. By threading the outer sleeve 32 into the recess 34, the forward tapered end 40 of the conduit 20 is pressed firmly against a matching tapered conical face 42 in the housing 24 just forward of the socket 34. The tapered recess 42 opens into a longitudinal flow passage 44, which is the same size as, and coincident with, the flow passage 46 in the conduit 20, so as to be a forward extension thereof.

The flow passage 44 leads into an elongate cylindrical collimating chamber 48, defined by the housing 24. This chamber 48 in turn communicates directly with a small diameter nozzle opening 50, formed in the nozzle assembly 26. As indicated previously herein, the relationship of this chamber 48 relative to the nozzle opening is of particular significance in the present invention, and will be discussed more particularly hereinafter in the description of the operation of the present invention.

The aforementioned nozzle assembly 26 comprises a nozzle housing 52 having a longitudinal through opening 53 and comprising a rear mounting portion 54 and a forwardly extending stem 56 that fits loosely in a forward cap member 58. This cap member 58 threads onto the forward end of the housing 24 to press against the nozzle housing 52 so that a rearwardly tapering conical surface 60 of the nozzle housing 52 bears against a matching surface 62 of the housing 24 to form a seal between the nozzle housing 52 and the housing 24.

At the center rear portion of the nozzle housing 52 there is formed a cylindrical recess or counterbore 64 in which is mounted a nozzle element or orifice 66 in which is formed the nozzle discharge opening 50. The nozzle element 66 is in and of itself of conventional design; it has a cylindrical configuration and is made of a suitable material, such as sapphire. The rear edge of the nozzle element 66 that defines the entrance to the nozzle opening 50 is desirably a right angle edge that is very slightly rounded to reduce wear. Surrounding the nozzle element 66 and in contact therewith is a mounting ring 68 made of a moderately yielding plastic material. The ring 68 is press fitted into the annular recess formed by the side wall of the cavity 64 and the side wall of the nozzle element 66. When the nozzle assembly 26 is subjected to the very high pressures from the fluid in the collimating chamber 48, the resulting pressure against the rear exposed surfaces of the nozzle element 66 and the ring 68 causes the mounting ring 68 to press radially inwardly against the nozzle element 66 with substantially uniform pressure, so as to alleviate any tendency for such inward pressure to crack or otherwise damage the nozzle element 66. Also, with the front surface of the nozzle element 66 pressing against the bottom surface of the counterbore 64 in the nozzle housing 52, the mounting ring 68 provides a seal for the engaging surfaces of the nozzle element 66 and the nozzle housing 52 without extrusion of the ring between such engaging surfaces.

To describe the operation of the present invention, the pressure intensifier 16 delivers liquid, such as water, through the conduit 20 to the discharge assembly 22 at a sufficiently high pressure (e.g. 20,000 to 100,000 psi) to produce a relatively narrow fluid jet (e.g. having a diameter from possibly as small as a thousandth of an inch up to about fifteen thousandths of an inch for cutting applications now contemplated). For higher power input cutting applications, the diameter of the fluid jet may be somewhat larger. The fluid jet being emitted has a sufficiently high velocity (at least approximately 1,000 feet per second, and more desirably in the order of 3,000 feet per second) to cut through a desired material.

The fluid flows through the passageway 46 of the conduit 20 into the connecting passageway 44 at the rear of the housing 24, and thence into the expanded collimating chamber 48. In the particular embodiment shown herein, the diameter of the fluid chamber 48 (indicated at *a* in FIG. 3) is approximately twice the diameter of the flow passage 46–44, with the cross sectional area of the flow chamber 48 thus being 4 times that of the passageway 46–44. Therefore, the velocity of the fluid passing through the chamber 48 is one quarter that of the fluid in the passageway 46–44. The fluid passes from the forward end of the chamber 48 directly into the nozzle opening 50 with the fluid discharging as a fluid jet stream, indicated at 70 in FIG. 3. This fluid jet steam passes freely through the nozzle housing opening 53, with the jet stream being collimated to the extent that it does not touch the side walls of the passageway 53.

It has been found that if the diameter *a* of the chamber 48 is made greater than 10 times the diameter of the nozzle opening 50 (which makes the cross sectional area of the chamber 48 greater than 100 times that of the nozzle opening 50), the collimation of the jet stream is substantially improved, with a resultant substantial enhancement of the cutting action of the fluid jet stream. When the diameter *a* is increased further so that the cross sectional area of the chamber 48 is greater than 400 and as high as 1,000 or 1,400 times that of the nozzle 50, there is even greater improvement in the collimation of the jet, with no substantial improvement being noticed beyond the 1,400 ratio. This phenomenon is discussed more fully previously herein in the Summary of the Invention.

In an actual apparatus constructed as shown herein, with a nozzle 50, having a diameter of one hundredth of an inch, and the diameter of the conduit passage 44 one eighth inch in diameter, the collimating chamber 48 was constructed in three configurations: (1) a diameter of one-quarter inch, (2) a diameter of three-eighths inch, and (3) a diameter of one-half inch. The configuration with the collimating chamber one-quarter inch produced significant improvement over the prior art, and the configuration with the three-eighths inch diameter collimating chamber produced yet further significant improvement. However, in this particular arrangement, the configuration with the one-half inch diameter did not provide significant improvement over the three-eighths inch diameter configuration.

In the particular nozzle assembly shown herein, there is a tendancy for the nozzle element 66 and the mounting ring 68 to compress unequally under high fluid pressures, with the result that there is a possible source of turbulence at the juncture line of these elements 66 and 68. However, it has been found that if the diameter of the nozzle element 66 is at least 7 times the diameter of the nozzle opening 50, and desirably as high as 10 times, this potential source of turbulence is of very minimal effect on the collimation of the fluid jet stream passing from the nozzle opening 50. In the present embodiment, the length of the chamber 48 (indicated at *d* in FIG. 2) is approximately 10 times the diameter *a* of the chamber 48. This has been found to be satisfactory for accomplishing the intended function of this collimating chamber 48.

What is claimed is:

1. In a high velocity, constant flow, liquid jet cutting apparatus, where there is a source of a high pressure liquid, a high velocity nozzle having a nozzle opening of a predetermined cross sectional area through which said liquid is directed as a high velocity liquid cutting jet, and high pressure conduit means to deliver the liquid from said source to the nozzle, an improvement to enhance collimation of the liquid jet to improve its cutting action, said improvement comprising:

housing means interconnected between the conduit and the nozzle, said housing means defining an elongate flow collimating chamber directly upstream of said nozzle to receive the liquid from the conduit means and deliver the liquid to the nozzle, said chamber having a cross sectional area greater than 100 times that of the nozzle opening.

2. The improvement as recited in claim 1, wherein the cross sectional area of the flow collimating chamber is greater than 200 times that of the discharge opening of the nozzle.

3. The improvement as recited in claim 1, wherein the cross sectional area of the flow collimating chamber is at least about 400 times that of the discharge opening of the nozzle.

4. The improvement as recited in claim 1, wherein the cross sectional area of the flow collimating chamber is at least about 1,000 times that of the discharge opening of the nozzle.

5. The improvement as recited in claim 1, wherein the cross sectional area of the flow collimating chamber is at least about 1,400 times that of the discharge opening of the nozzle.

6. The improvement as recited in claim 1, further comprising a nozzle assembly mounted at the discharge end of said housing means, said nozzle assembly comprising:

a. a nozzle housing mounted at the forward end of said flow collimating chamber and having a nozzle element mounting recess;

b. a nozzle element having a discharge opening therein mounted in said recess so as to be in contact with a forward surface of said recess, and c. a mounting ring of a yieldable material surrounding said nozzle element so as to be in contact therewith, and press fitted into said recess, whereby with high pressure fluid in said flow collimating chamber, said mounting ring provides a seal between said nozzle element and said nozzle housing, and also exerts a substantially uniform radially inward pressure against said nozzle element.

7. The improvement as recited in claim 6, wherein the diameter of said nozzle element is at least approximately 7 times the diameter of the nozzle opening.

8. The improvement as recited in claim 6, wherein the nozzle element has a diameter of at least approximately 10 times that of the nozzle opening.

9. The improvement as recited in claim 6, wherein said nozzle housing has a rearwardly tapering conical surface in contact with a matching conical surface of said housing means so as to form a seal between said nozzle housing and said housing means.

10. In a process of high velocity, constant flow, liquid jet cutting, where high pressure fluid is directed from a high pressure source through a conduit and thence through a nozzle opening of a predetermined cross sectional area to provide a high velocity relatively thin cutting jet, an improvement to enhance collimation of the liquid jet to improve the cutting action thereof, said improvement comprising directing said liquid from the conduit through an elongate flow collimating chamber interposed between the conduit and the nozzle opening and having a cross sectional area greater than 100 times that of the nozzle opening, and thence from the flow collimating chamber directly to a discharge opening of said nozzle.

11. The improvement as recited in claim 10, wherein said liquid is directed through a collimating chamber having a cross sectional area greater than 200 times that of the nozzle opening.

12. The improvement as recited in claim 10, wherein said liquid is directed through a collimating chamber having a cross sectional area at least about 400 times that of the nozzle opening.

13. The improvement as recited in claim 10, wherein said liquid is directed through a collimating chamber having a cross sectional area greater than 1,000 times that of the nozzle opening.

14. The improvement as recited in claim 10, wherein said liquid is directed through a collimating chamber having a cross sectional area greater than 1,400 times that of the nozzle opening.

* * * * *